US009562377B2

(12) United States Patent
Attard

(10) Patent No.: US 9,562,377 B2
(45) Date of Patent: Feb. 7, 2017

(54) DOOR LATCH

(71) Applicant: Joseph Attard, Washago (CA)

(72) Inventor: Joseph Attard, Washago (CA)

( * ) Notice: Subject to any disclaimer, the term of this patent is extended or adjusted under 35 U.S.C. 154(b) by 0 days.

(21) Appl. No.: 14/924,451

(22) Filed: Oct. 27, 2015

(65) Prior Publication Data

US 2016/0115717 A1 Apr. 28, 2016

Related U.S. Application Data

(60) Provisional application No. 62/069,415, filed on Oct. 28, 2014.

(51) Int. Cl.

| | |
|---|---|
| ***E05B 67/00*** | (2006.01) |
| ***E05C 1/04*** | (2006.01) |
| ***E05B 67/38*** | (2006.01) |
| *E05B 63/00* | (2006.01) |

(52) U.S. Cl.

CPC ..... *E05C 1/04* (2013.01); *E05B 67/383* (2013.01); *E05B 2063/0039* (2013.01)

(58) Field of Classification Search

CPC ..... E05B 85/22; E05C 1/00; E05C 1/004; E05C 1/006; E05C 1/02; E05C 9/22; Y10S 292/15

USPC ..... 292/137, 138, 143

See application file for complete search history.

(56) References Cited

U.S. PATENT DOCUMENTS

| | | | | | |
|---|---|---|---|---|---|
| 19,588 | A | * | 3/1858 | Scripture | E05B 65/0864 292/58 |
| 558,786 | A | * | 4/1896 | Doyle | E06B 7/18 16/82 |
| 777,135 | A | * | 12/1904 | Parsons | E05B 65/0864 292/205 |
| 1,170,252 | A | * | 2/1916 | Harrison | E05B 85/22 292/173 |
| 1,228,996 | A | * | 6/1917 | Walters | E05B 65/0864 292/152 |
| 1,300,912 | A | * | 4/1919 | Yarberry | E05B 65/0864 292/288 |
| 1,326,554 | A | * | 12/1919 | Watson | E05C 3/12 292/205 |
| 1,332,479 | A | * | 3/1920 | Wilkinson | E05C 17/365 292/57 |
| 2,403,065 | A | | 7/1946 | Engert | |
| 2,587,167 | A | | 2/1952 | Kelley | |
| 3,561,804 | A | * | 2/1971 | Brown | E05C 1/04 292/153 |

(Continued)

*Primary Examiner* — Janet M Wilkens

(74) *Attorney, Agent, or Firm* — Lando & Anastasi, LLP

(57) ABSTRACT

The apparatus includes: a plate having a slot defining an axis and adapted to be mounted to a face of a door having an aperture disposed adjacent the door edge such that the slot communicates with the aperture and the axis is disposed normally to the edge; an assembly secured to the plate; a bolt slidably mounted in use to the assembly for axial movement between: a first position, wherein one end of the bolt projects beyond the edge and the other end of the bolt is disposed in overlying relation to the slot, relatively proximal to the edge; and a second position, wherein the one end overlies the door and the other end is disposed in overlying relation to the slot relatively distal to the edge; and a handle connected to the bolt and defining a pair of grippable portions that, in use, project outwardly from the door faces.

4 Claims, 8 Drawing Sheets

(56) References Cited

U.S. PATENT DOCUMENTS

| | | | | |
|---|---|---|---|---|
| 3,797,868 | A * | 3/1974 | Carey | E05C 17/365 292/262 |
| 3,955,837 | A | 5/1976 | Christensen | |
| 4,512,105 | A | 4/1985 | Norton | |
| 4,997,219 | A | 3/1991 | Carter | |
| 5,799,990 | A | 9/1998 | Hardee | |
| 6,345,849 | B1 * | 2/2002 | Yen | E05C 17/54 292/292 |
| 7,272,963 | B2 | 9/2007 | Rosenberg et al. | |
| 7,726,706 | B2 | 6/2010 | Moran | |
| 7,798,544 | B1 | 9/2010 | Bates | |
| 8,453,606 | B2 | 6/2013 | Brown et al. | |
| 2015/0035289 | A1 * | 2/2015 | Guerrero | E05B 17/2076 292/64 |

* cited by examiner

DOOR LATCH

CROSS-REFERENCE TO RELATED APPLICATIONS

This application claims priority to U.S. Provisional Application Ser. No. 62/069,415, titled "DOOR LATCH," filed on Oct. 28, 2014, which contents are hereby incorporated herein by reference in its entirety for all purposes.

FIELD OF THE INVENTION

The invention relates to the field of latches.

BACKGROUND OF THE INVENTION

Latches are well-known, and are widely-used in the field of outdoor gates. However, known latches often loosen in use, and fail. Other known latches can be difficult to install correctly.

SUMMARY OF THE INVENTION

Forming one aspect of the invention is apparatus for use with a door.

The door:

has a fixed edge pivotably mounted in use to provide for movement of the door to and from a closed position;

has opposed front and back faces;

has a free edge normal to or opposite the fixed edge; and has an aperture disposed adjacent the free edge.

The apparatus comprises a plate, a mounting assembly, a bolt and a handle.

The plate has a slot defining an axis and is adapted to be mounted to one of the door faces such that the slot communicates with the aperture and the axis is disposed in perpendicular relation to the free edge.

The mounting assembly is secured to the plate.

The bolt has opposed ends and is slidably mounted in use to the mounting assembly for movement parallel to the axis between: a first position, wherein one of the ends of the bolt projects beyond the edge and the other of the ends of the bolt is disposed in overlying relation to the slot, relatively proximal to the edge; and a second position, wherein the one of the ends overlies the door and the other of the ends is disposed in overlying relation to the slot relatively distal to the edge.

The handle is fixedly connected to the bolt and defines a pair of manually grippable portions that, in use, project outwardly from the door faces.

According to another aspect, the mounting assembly can be defined by one or more sleeves through which the bolt passes.

According to another aspect, the apparatus can further comprise a backer having a slot, the slot defining an axis, the backer being adapted to be mounted to the other of the door faces such that the slot communicates with the aperture and the axis is disposed in perpendicular relation to the edge.

According to another aspect, the apparatus can further comprise a flange connected in perpendicular relation to the backer which flange, in use, abuts the door edge.

According to another aspect, the apparatus can further comprise a flange connected in perpendicular relation to the backer which flange, in use, abuts the door edge.

Forming another aspect of the invention is apparatus for use with a door assembly including a door and a frame.

The door:

has a fixed edge pivotably mounted to the frame for movement of the door to and from a closed position;

has opposed front and back faces;

has a free edge opposite the fixed edge; and has an aperture disposed adjacent the free edge.

The apparatus comprises a plate, a mounting assembly, a bolt and a handle.

The plate has a slot defining an axis and is adapted to be mounted to one of the door faces such that the slot communicates with the aperture and the axis is disposed in perpendicular relation to the free edge.

The mounting assembly is secured to the plate.

The bolt has opposed ends and is slidably mounted in use to the mounting assembly for movement parallel to the axis between: a first position, wherein one of the ends of the bolt projects beyond the edge and the other of the ends of the bolt is disposed in overlying relation to the slot, relatively proximal to the edge; and a second position, wherein the one of the ends overlies the door and the other of the ends is disposed in overlying relation to the slot relatively distal to the edge.

The handle is fixedly connected to the bolt and defines a pair of manually grippable portions that, in use, project outwardly from the door faces.

According to yet another aspect, the apparatus can further comprise a catch member defining a socket, the catch member being adapted to be mounted to the frame of the door such that, when the door is in the closed position and the bolt is moved from the second to the first position, the socket receives the bolt to restrain the door against movement.

Other features and advantages of the invention will become apparent upon reviewing of the description which follows and the appended drawings, the latter being briefly described hereinafter.

DETAILED DESCRIPTION OF THE EXEMPLARY EMBODIMENTS

Figure 1:
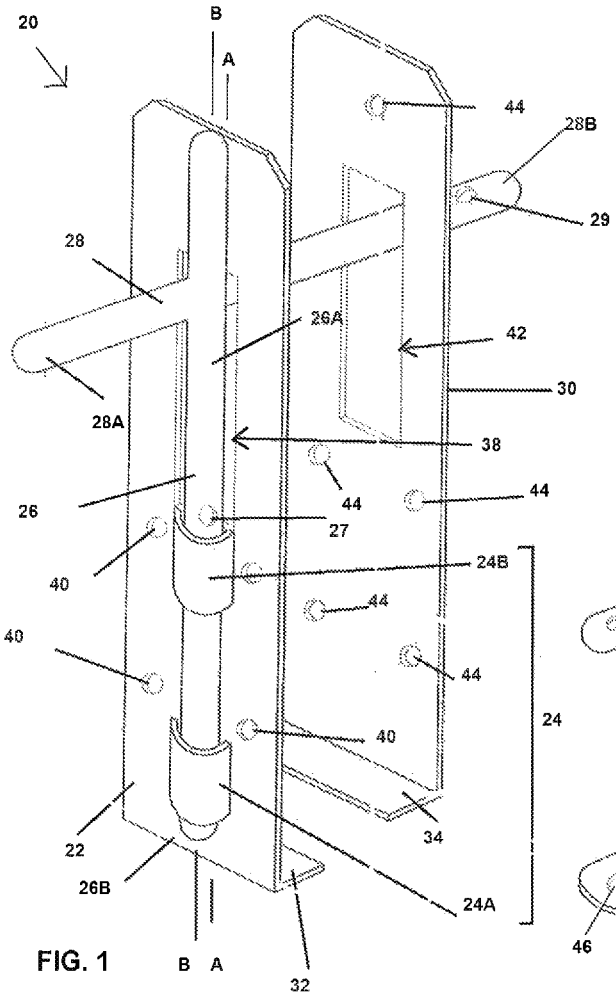
FIG. 1 is a perspective view of apparatus according to an exemplary embodiment of the invention.
Figure 2:
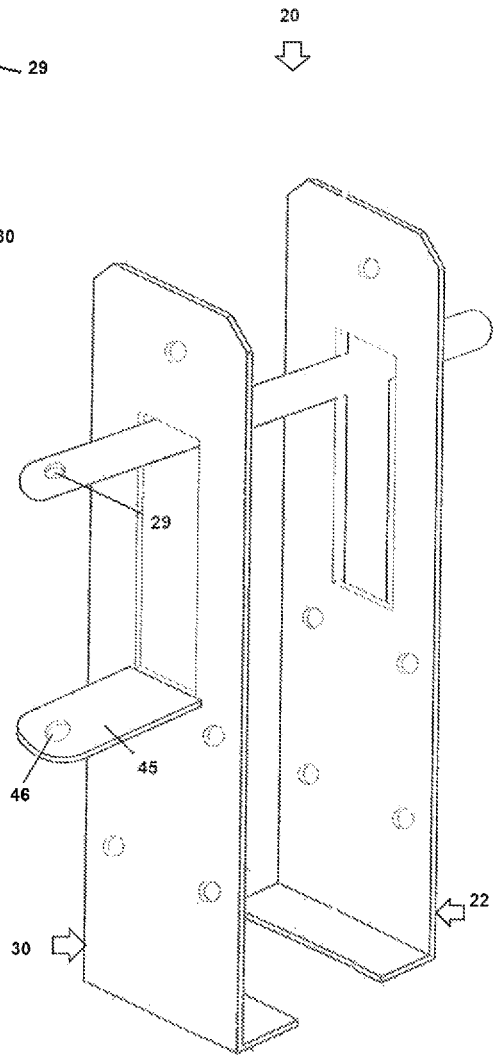
FIG. 2 is a view of the apparatus of FIG. 1 from another vantage point.

Reference is now made to FIG. 1 and FIG. 2 and the apparatus 20 shown therein.

The apparatus will be seen to include a plate 22, a mounting assembly 24, a bolt 26, a handle 28, a backer 30 and a pair of flanges 32, 34.

The plate 22 has a slot 38 and a plurality of holes 40 defined around the perimeter. The slot 38 defines a slot axis A-A.

The mounting assembly 24 is defined by a pair of sleeves 24A, 24B disposed in coaxial relation to a common axis B-B and spaced apart therealong, the sleeves being securely mounted to the plate 22 such that the common axis B-B is parallel to and overlies the slot axis A-A.

The bolt has opposed ends 26A, 26B and an aperture 27 defined therethrough.

The handle 28 is fixedly connected in perpendicular relation to the bolt 26 and defines a pair of manually grippable portions 28A, 28B. Portion 28B has an aperture 29 defined therethrough.

The backer 30 has a slot 42 and a plurality of holes 44 defined around the perimeter. The backer further has a tab 45 disposed at one end of the slot 42, the tab 45 having an aperture 46 defined therethrough.

The flanges are provided one for each of the plate and the backer. The flange 32 provided for the plate 22 projects in perpendicular relation to the plate. The flange 34 provided for the backer 30 projects in perpendicular relation to the backer 30.

Figure 3:
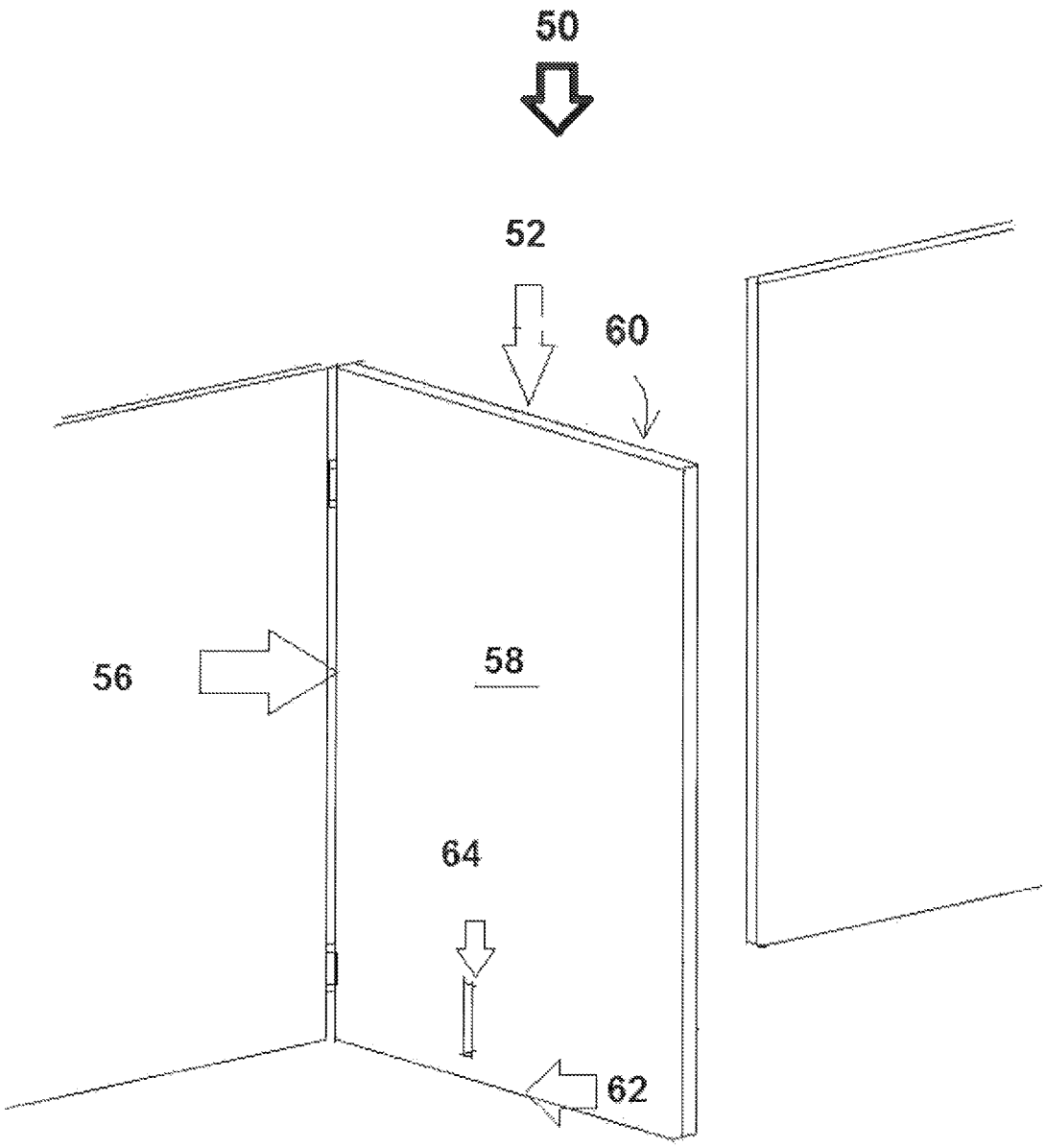
FIG. 3 is a front view of a door assembly with which the apparatus of FIG. 1 can be used.

Reference is now made to FIG. 3, which shows a door assembly 50 with which the apparatus can be used, the door assembly including a door 52. The door 52, which will be understood to form no part of the invention, is of the type having:

- a fixed edge 56 pivotably mounted for movement of the door 52 to and from a closed position;
- opposed front and back faces 58,60;
- a free edge 62 adjacent the fixed edge 56; and
- an aperture 64 disposed adjacent the free edge 62.

Figure 4A:
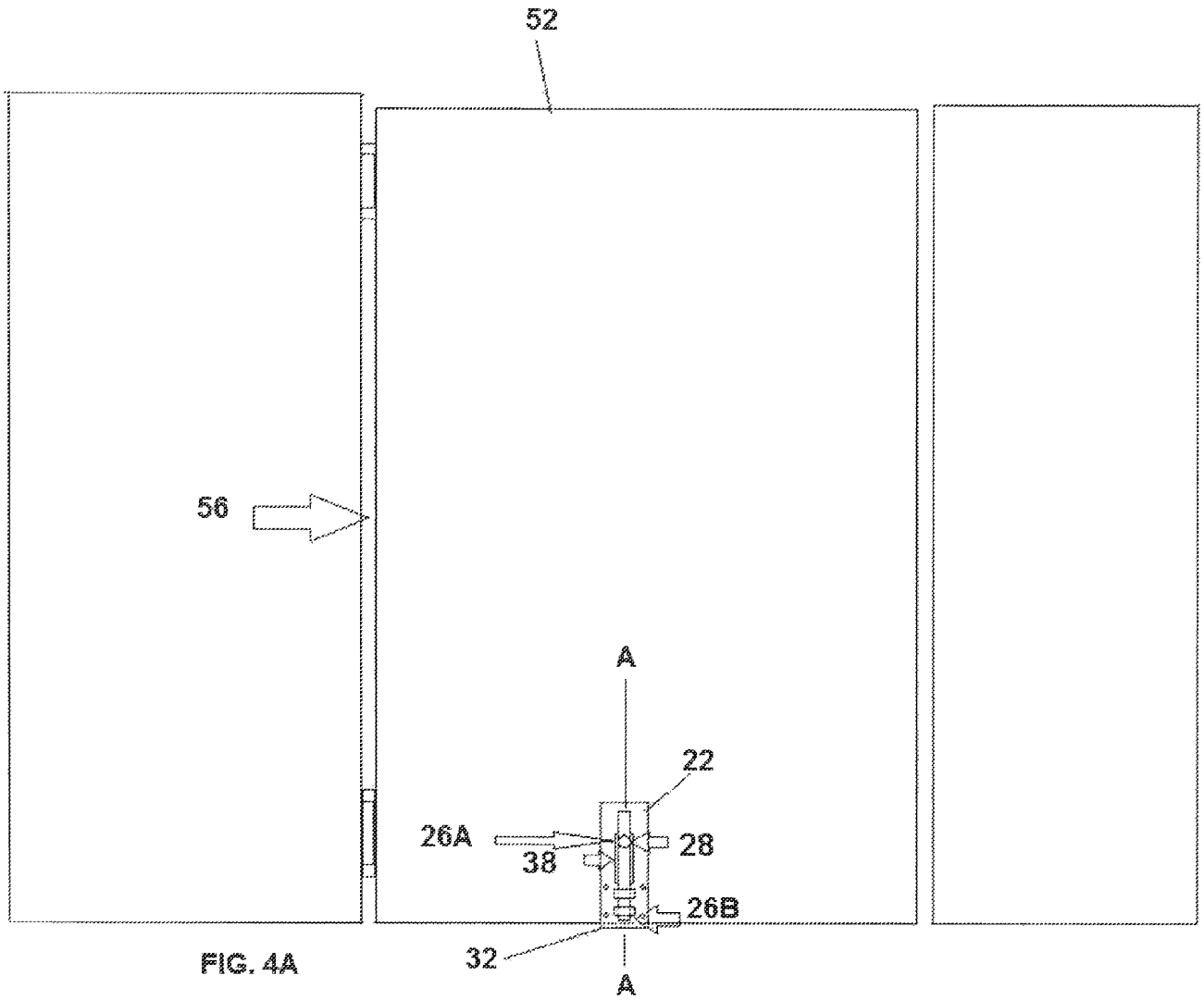
FIG. 4A is a view of the apparatus of FIG. 1 in use with the structure of FIG. 3.

In use, as suggested in FIG. 4A:

- the plate 22 is mounted to one 58 of the door faces, by the passage of screws or the like through the holes 40 into the door 52, such that the slot 38 communicates with the aperture 64 [not shown] and the slot axis A-A is disposed in perpendicular relation to the free edge 62 and such that the flange 32 of the plate abuts the free edge 62
- the backer 30 is mounted to the other 60 of the door faces, by the passage of screws through the holes 44 into the door 52, such that the slot 42 communicates with the aperture 64 [none shown]
- the bolt 26 extends through the sleeves 24A,24B and is thereby slidably mounted to the mounting assembly 24 for movement parallel to the common axis B-B between a first position and a second position.

In the first position, one 26B of the ends of the bolt projects beyond the free edge 62 and the other 26A of the ends of the bolt 26 is disposed in overlying relation to the slot 38, relatively proximal to the free edge 62. In the second position, the one 26B of the ends overlies the door 52 and the other of the ends 26A is disposed in overlying relation to the slot 38 relatively distal to the free edge 62.

Figure 4B:
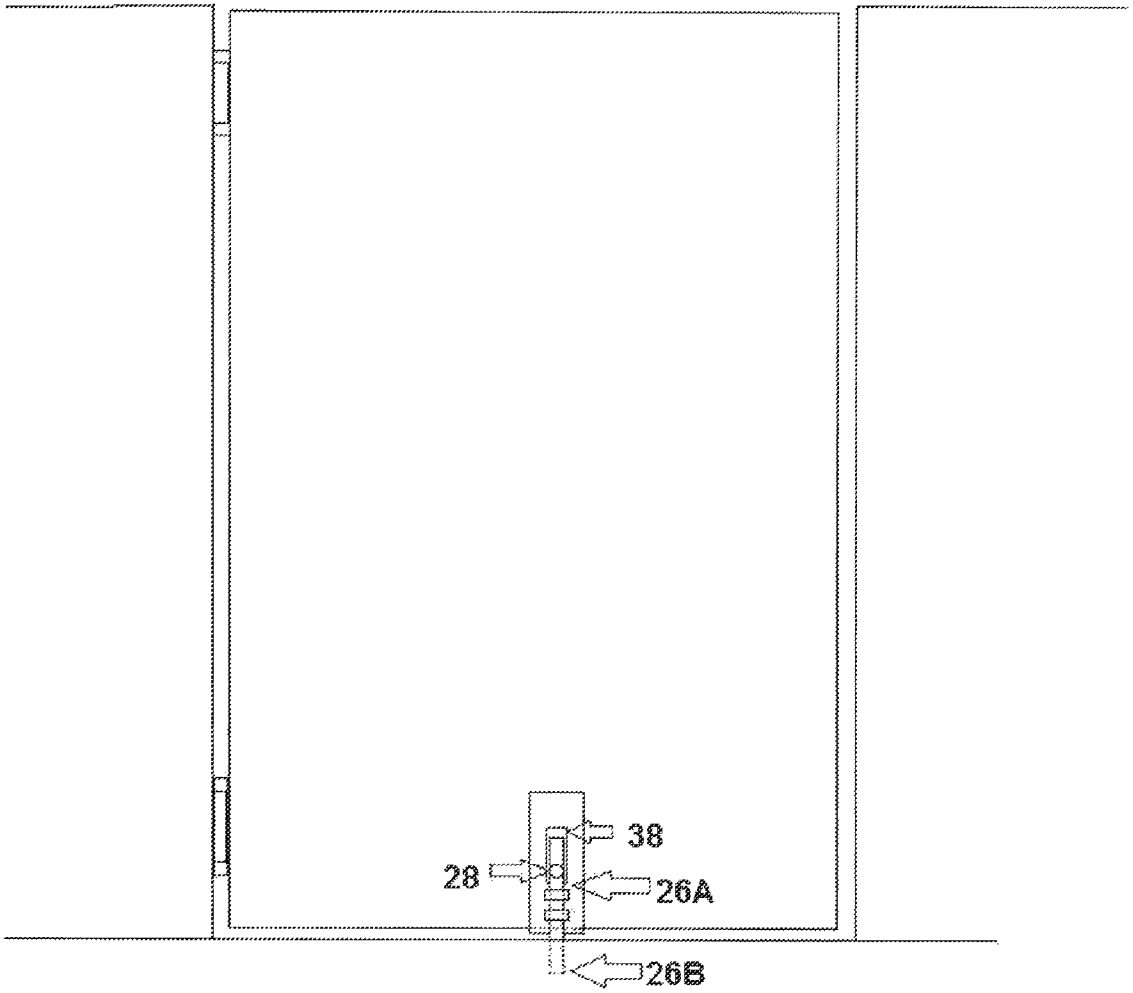
FIG. 4B is a view similar to FIG. 4A, with the bolt shown in the closed position.

Thus:

- when the bolt 26 is in the second position, as shown in FIG. 4A, the door 52 can be freely moved; and
- the bolt can be moved to the first position, as shown in FIG. 4B, whereat the end of the bolt that projects beyond the door edge engages the ground, thereby securely restraining the door against movement.

Figure 5:
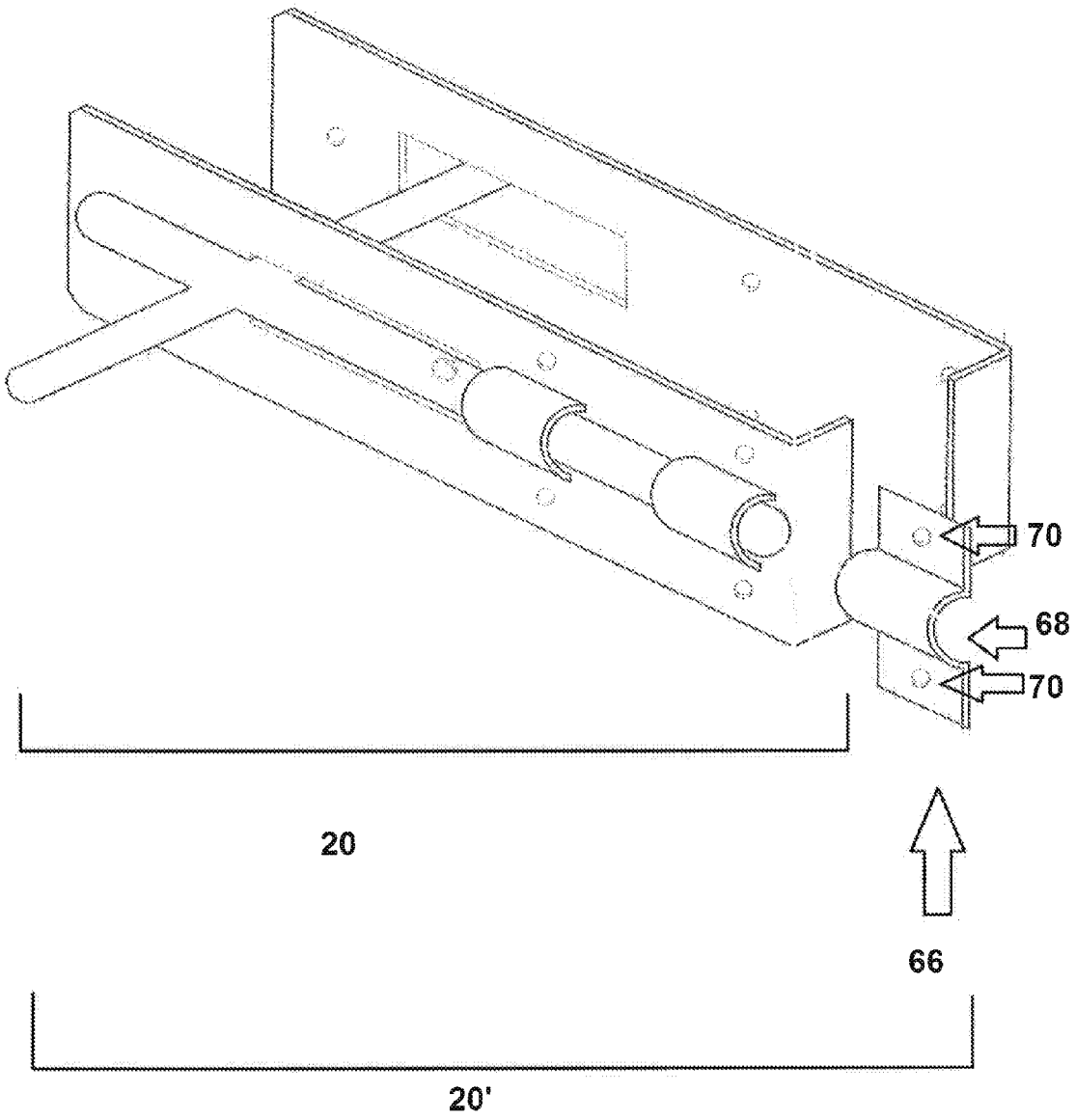
FIG. 5 is a perspective view of apparatus according to another exemplary embodiment of the invention.

Reference is now made to FIG. 5, which shows apparatus 20' according to another exemplary embodiment of the invention. This apparatus 20' includes all of the structure of apparatus 20, but further include a catch member 66. The catch member defines a socket 68 and has a pair of holes 70 for receiving screws.

Figure 6:
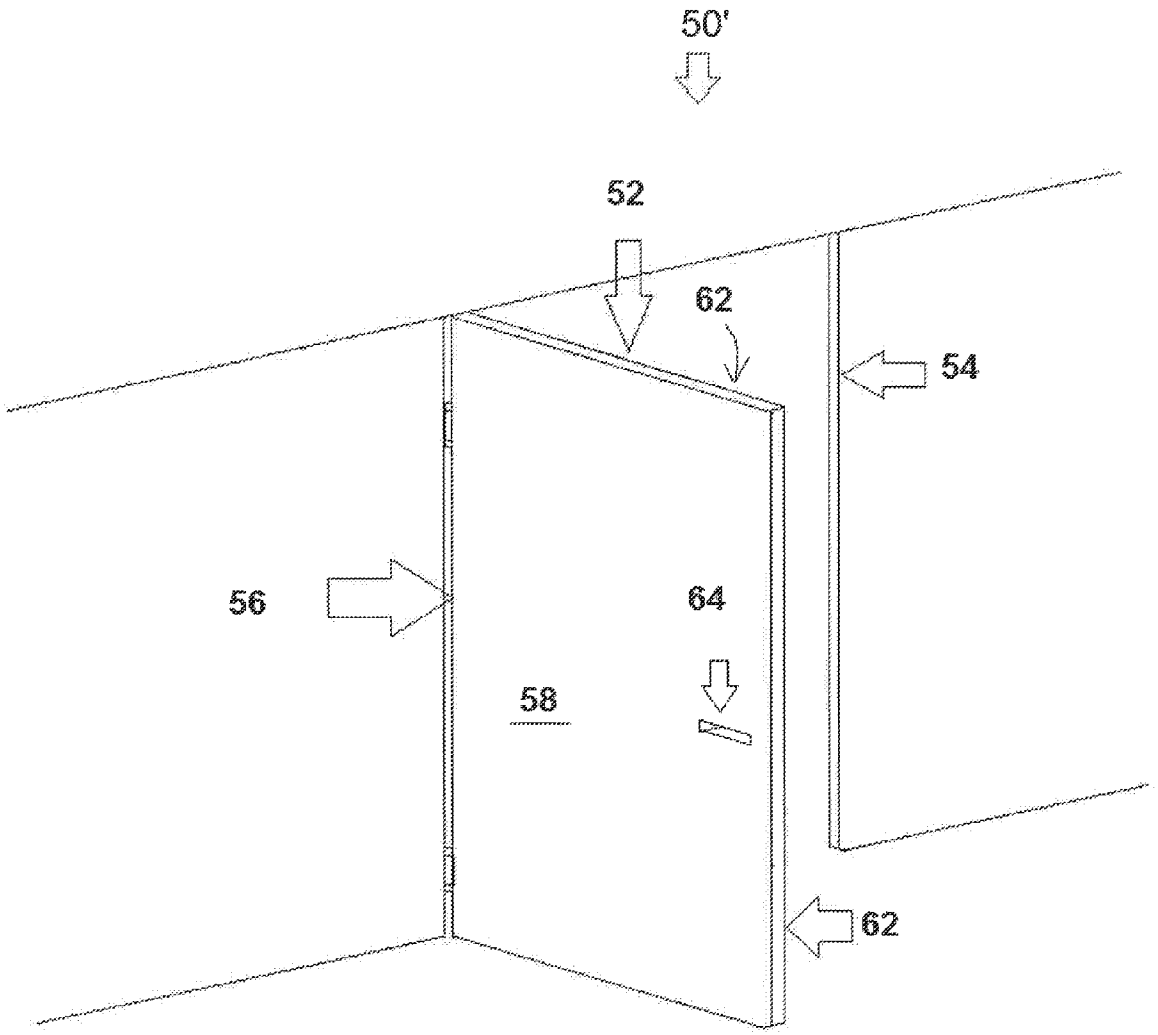
FIG. 6 is a front view of a door assembly with which the apparatus of FIG. 5 can be used.

FIG. 6 shows a door assembly 50' with which the apparatus of FIG. 5 can be used. This assembly 50' is similar to the assembly 50 shown in FIG. 3, but herein, the slot 64 is disposed opposite the fixed edge 56.

Figure 7A:
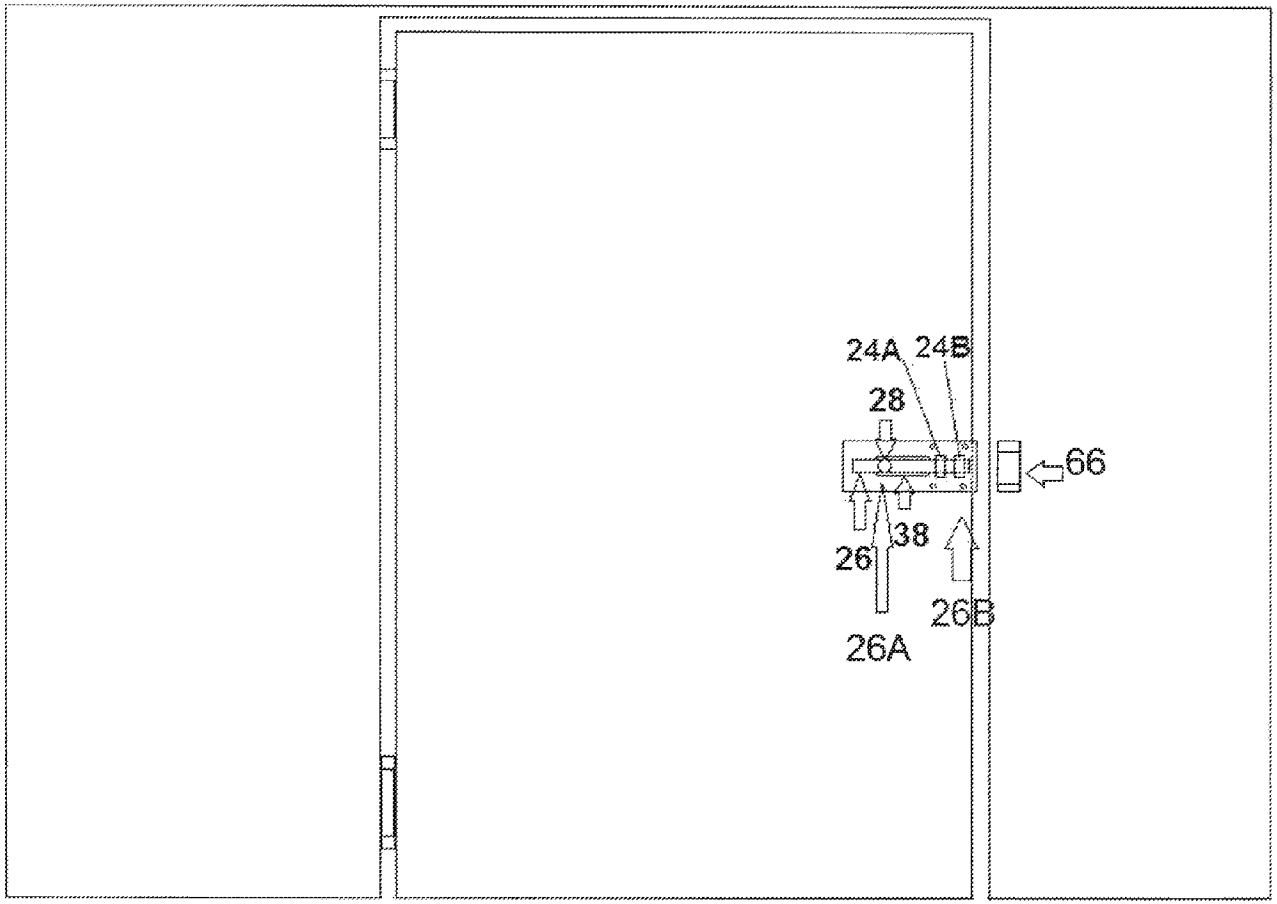
FIG. 7A is a view of the apparatus of FIG. 5 in use with the structure of FIG. 6.
Figure 7B:
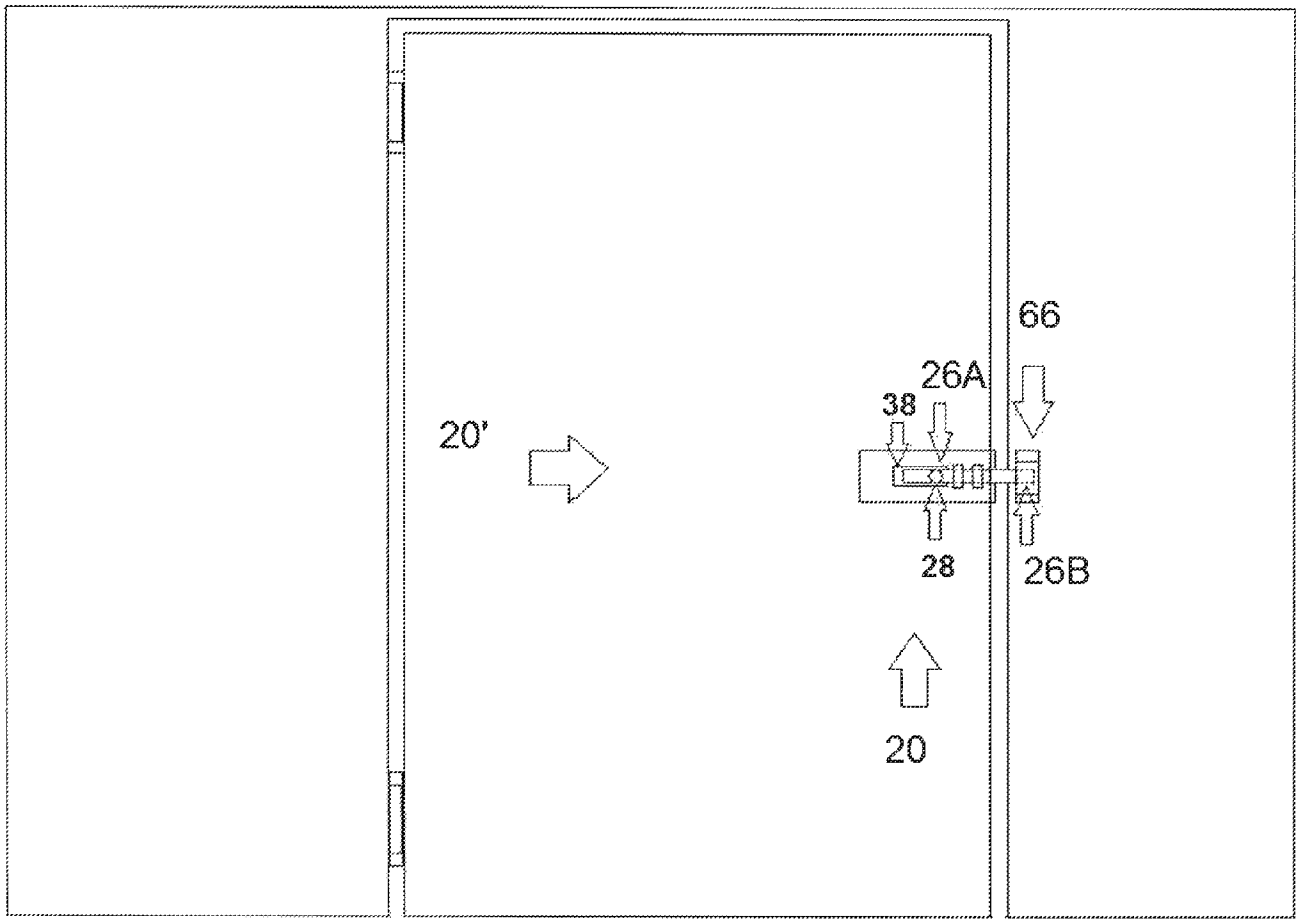
FIG. 7B is a view similar to FIG. 7A, with the bolt shown in the closed configuration.

FIG. 7A shows the apparatus 20' of FIG. 5 in use with the structure of FIG. 6, wherein it will be seen that:

- the portion of apparatus 20' defined by apparatus 20 is installed in the same manner as described previously
- catch member 66 is secured to the door frame such that, when the door is closed, catch member 66 is disposed adjacent the slot in the door Apparatus 20' operates in the same manner as described in relation to apparatus 20, but whereas the bolt in apparatus 20 engages in the soil, the bolt 26 in apparatus 20' engages in the socket 68 when the bolt is in the first position.

Whereas in both embodiments described, the bolt is free for movement between the first and second positions, it will be appreciated that in some situations, it may be advantageous to restrain the bolt in either the first position or the second position, to securely lock the door against movement or to ensure that the door is not locked. In this regard, it will be appreciated that the bolt can be locked in the second position by passing a padlock through apertures 29 and 46, and in the first position by passing a padlock through aperture 27 [neither shown].

Persons of ordinary skill will appreciate that the invention allows for the construction of a door latch that is relatively inexpensive to manufacture, relatively robust and relatively flexible in use.

Whereas but two embodiments are herein shown and described, variations are possible. Accordingly, the invention should be understood to be limited only by the accompanying claims, purposively construed.

The invention claimed is:

1. An apparatus for use with a door having opposed faces, an edge and an aperture disposed adjacent the edge, the apparatus comprising:

- a plate having a slot, the slot defining an axis, the plate being adapted to be mounted to a door face such that the slot communicates with the aperture and the axis is disposed in perpendicular relation to the edge;
- a mounting assembly secured to the plate;
- a bolt having opposed ends and slidably mounted in use to the mounting assembly for movement parallel to the axis between: a first position, wherein one of the ends of the bolt projects beyond the edge and the other of the ends of the bolt is disposed in overlying relation to the slot, relatively proximal to the edge; and a second position, wherein the one of the ends is configured to overlie the door and the other of the ends is disposed in overlying relation to the slot relatively distal to the edge;
- a handle fixedly connected to the bolt and defining a pair of manually grippable portions that, in use, project outwardly from the door faces; and
- a backer having a backer slot, the backer slot defining an axis, the backer being adapted to be mounted to the other of the door faces such that the backer slot communicates with the aperture and the axis is disposed in perpendicular relation to the edge.

2. The apparatus according to claim 1, wherein the mounting assembly is defined by one or more sleeves through which the bolt passes.

3. The apparatus according to claim 1, further comprising a flange connected in perpendicular relation to the backer which, in use, abuts the door edge.

4. The apparatus according to claim 1, further comprising a catch member defining a socket, the catch member being adapted to be mounted to the frame of the door such that, when the door is closed and the bolt is moved from the second to the first position, the socket receives the bolt to restrain the door against movement.

* * * * *